US006073567A

United States Patent [19]

Aoki

[11] Patent Number: 6,073,567

[45] Date of Patent: Jun. 13, 2000

[54] PRESSER FOOT DEVICE FOR A SEWING MACHINE

[75] Inventor: Keiichi Aoki, Ichinomiya, Japan

[73] Assignee: Kabushikikaisha Barudan, Japan

[21] Appl. No.: 09/073,828

[22] Filed: May 7, 1998

[30] Foreign Application Priority Data

May 9, 1997 [JP] Japan ..... 9-135940
Jul. 31, 1997 [JP] Japan ..... 9-221031

[51] Int. Cl.[7] ..... D05B 29/02

[52] U.S. Cl. ..... 112/237

[58] Field of Search ..... 112/237, 236, 112/238, 239

[56] References Cited

U.S. PATENT DOCUMENTS 4,285,289 8/1981 Bolldorf et al. ..... 112/237 X
4,915,044 4/1990 Kambara et al. ..... 112/236

FOREIGN PATENT DOCUMENTS 1103483 5/1986 Japan ..... 112/237
6238078 8/1994 Japan .
7231991 5/1995 Japan .

*Primary Examiner*—Ismael Izaguirre
*Attorney, Agent, or Firm*—William A. Drucker

[57] ABSTRACT

The load which is applied during a period when a presser foot is retracted is reduced, and the time period required before the restart of the sewing operation is shortened.

A swing member which is swung in a predetermined range by a cam for driving a presser foot and fixed to the main shaft is coupled also with the presser foot through a link. The presser foot is vertically moved by the link mechanism in synchronization with the rotation of the main shaft. Joint movement direction controlling device is disposed. The device restricts the direction of a reciprocation locus of one joint of the link mechanism, and changes the movement direction of the reciprocation, thereby causing the second swing member to operate so as to vertically move the presser foot in a predetermined range, and the presser foot to be set in a raised state in which the presser foot is raised to a retraction position.

5 Claims, 12 Drawing Sheets

PRESSER FOOT DEVICE FOR A SEWING MACHINE

TECHNICAL FIELD

The present invention relates to a presser foot device for a sewing machine.

BACKGROUND ART

Conventionally, a known presser foot device for a sewing machine has a mechanism in which, during a sewing operation, a presser foot is vertically moved with a small stroke in a predetermined range, and, in other operations such as a thread cutting operation and a frame movement, the presser foot is retracted as required to a position which is higher in level than the vertical movement range.

For example, Japanese patent publication (Kokai) No. 07231 991 A discloses a device in which a presser foot is attached via plural links to the tip end of a driving arm that is swung by the rotation of an eccentric cam, and the presser foot is vertically moved in synchronization with the rotation of the main shaft. When the presser foot is to be retracted, a retraction lever is rotated so that the driving arm is rotated in a direction along which the driving arm is separated from the eccentric cam. Although not shown in the figure, the publication discloses a structure in which a spring for causing a cam follower unit of the driving arm to abut against the eccentric cam is disposed.

Japanese patent publication (Kokai) No. 06238078 A discloses a device in which a cam groove for vertically moving a presser foot is formed in the outer peripheral face of a driving cam, a cam follower is fitted into the driving cam, and, during a sewing operation, the driving cam is rotated in synchronization with the main shaft, thereby vertically moving the presser foot with a predetermined stroke. A mechanism for upward retracting the presser foot is configured so that a retraction groove is formed in a part of the wall opposite to the cam face of the cam groove and, as required, the cam follower is retracted into the retraction groove, whereby the presser foot is moved through a link so as to be elevated to a retraction position. In the device, an urging force for abutting the cam follower against the cam face is produced by a second compression spring.

In such prior art techniques, when the presser foot is to be upward retracted, the cam follower must be moved against the urging force exerted by the spring which causes the cam follower to abut against the cam face. In order to move the cam follower with correctly following the cam face, the spring has a relatively large urging force. Therefore, a prior art device has a problem in that a large load is applied to a presser foot retraction mechanism. In an embroidery sewing machine, particularly, the number of heads is increasing. In such a multi-head sewing machine, therefore, the total of loads which are respectively applied to heads has a large value, with the result that, during a period when the main shaft of the multi-head sewing machine is rotated, a considerably large load is applied as a whole to the presser foot retraction mechanism. This load produces a large burden on the main shaft.

In the device disclosed in Japanese patent publication (Kokai) No. 06238078 A, when the presser foot which has been once retracted to a raised position is to be returned to an operating position, the main shaft cannot be driven until the cam follower is returned from the retraction groove into the cam groove. The device disclosed in Japanese patent publication (Kokai) No. 07231991 A has the structure in which the presser foot is retracted obliquely rearward. In the device also, therefore, the main shaft cannot be driven until the presser foot is returned to an operating position so that a through hole of the presser foot is positioned immediately below a stitching needle.

Consequently, such devices of the prior art have another problem in that a long period is required for the sewing operation to be restarted after a presser foot is retracted.

SUMMARY OF THE INVENTION

It is an object of the invention to solve these problems, reduce the load which is applied during a period when a presser foot is retracted, and shorten the time period required before the restart of the sewing operation.

The object can be attained by the characteristic configuration of the invention set forth in the appended claims. A preferred embodiment of the invention is indicated in the dependent claim.

In the presser foot device for a sewing machine of the application, during a period when a sewing operation is executed, a first swing member is swung in a predetermined locus in response to a rotation of a main shaft. Then, a second swing member which is coupled to the first swing member through a link is swung so as to vertically move a presser foot. At this time, one joint of a link mechanism is moved in one direction, and the range of the vertical movement of the presser foot is defined by the movement range of the joint. When the presser foot is to be raised to a retraction position, the movement direction of the joint is changed so that the movement range of the second swing member is changed. This change allows the presser foot to be raised to the retraction position.

The presser foot is caused only to be raised to the retraction position, and, also at the retraction position, an engagement between the presser foot and joint movement direction controlling means is maintained. Even when the main shaft is rotated during a period when the presser foot is returned from the retraction position to the sewing execution position, therefore, the presser foot is caused to perform only a vertical movement through the link mechanism. As a result, when the sewing operation is to be restarted after a presser foot is retracted, the rotation of the main shaft can be restarted before the presser foot is completely returned to the sewing execution position, and hence the time period required for restarting the sewing operation can be shortened.

The device is configured so that the presser foot is retracted without canceling the engagement of the mechanism during the retraction operation. Unlike a device of the prior art, therefore, it is not necessary to, during the sewing operation, apply an urging force in order to maintain the engagement of the cam mechanism. Consequently, it is possible to attain an effect that the load required for the retraction is reduced and the movement is smoothly conducted. Because of this effect as compared with devices of the prior art, the load which is applied during a period when the presser foot is retracted can be reduced and the load burden of the main shaft can be reduced.

According to the invention, therefore, the operation rate of a sewing machine can be improved. When the device is used in a multi-head sewing machine, particularly, it is expected to reduce the load and largely improve the operation rate in a temporal sense.

DESCRIPTION OF THE PREFERRED EMBODIMENT

Hereinafter, an embodiment of the invention will be described with reference to FIGS. 1 to 6.

Figure 1:
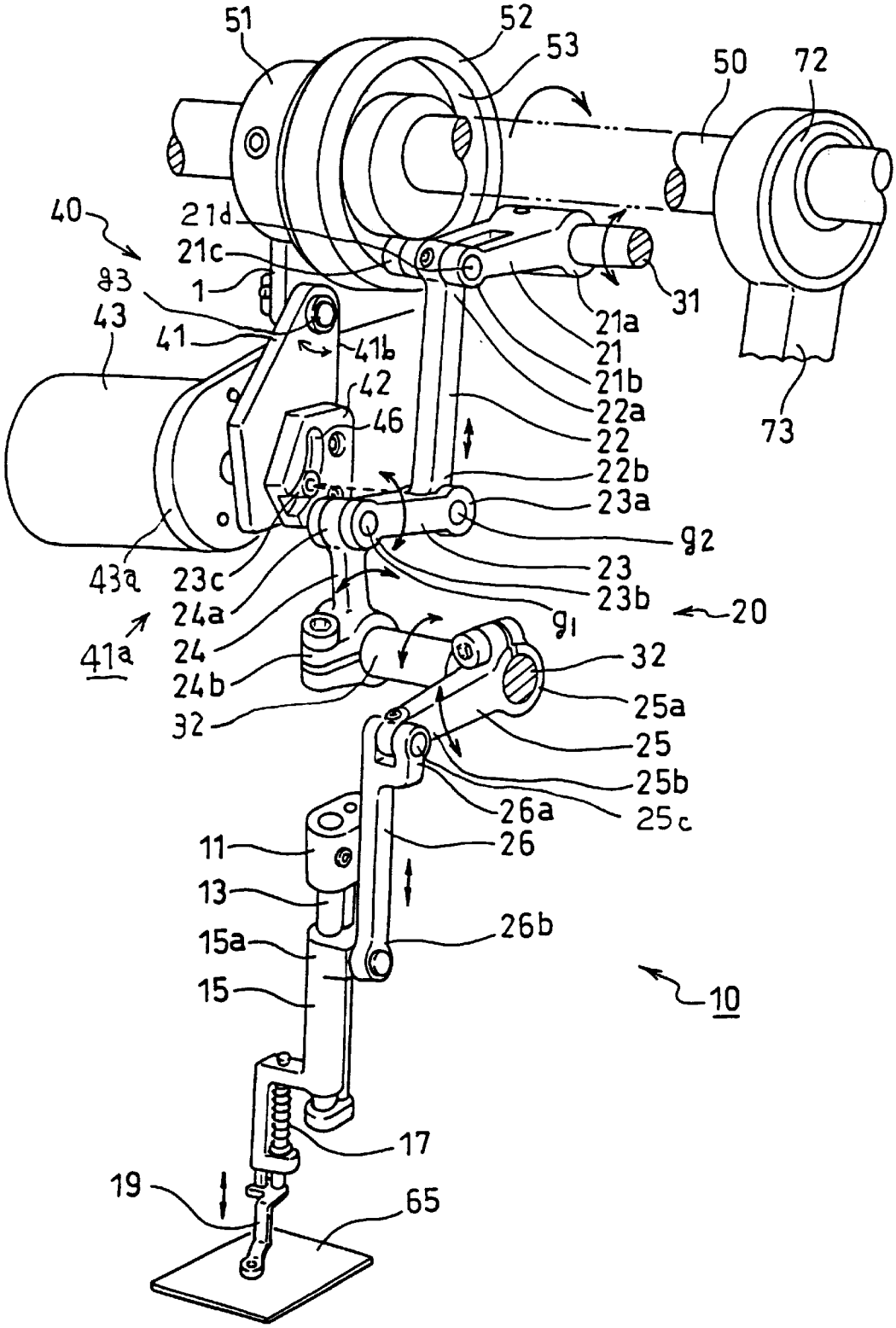
FIG. 1 is a perspective view showing main portions of a presser foot device for a sewing machine of an embodiment.
Figure 2:
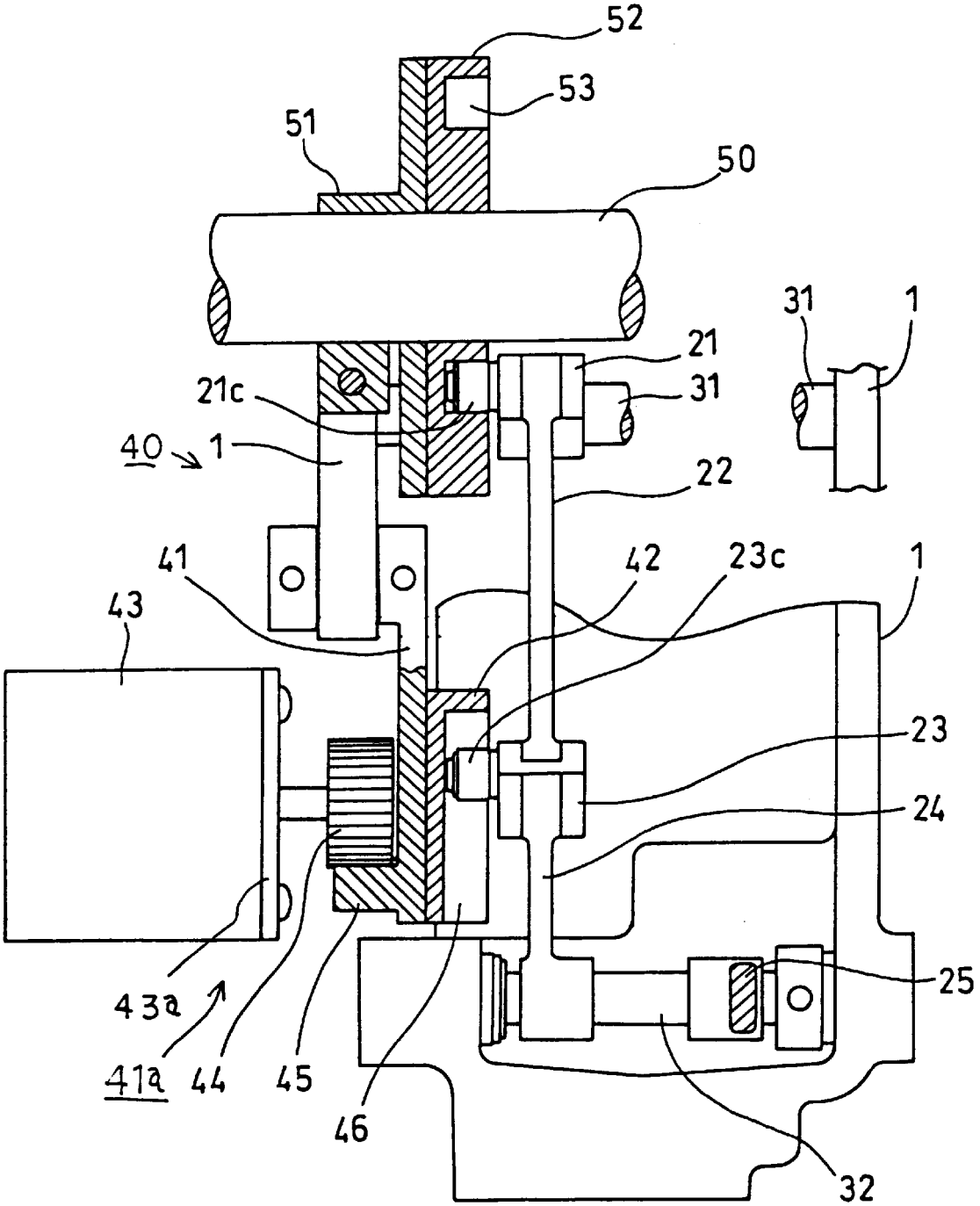
FIG. 2 is an enlarged section view of a part of the presser foot device for a sewing machine of the embodiment.

FIG. 1 is a perspective view showing the configuration of a presser foot device 10 for a sewing machine of the embodiment, and FIG. 2 is an enlarged section view of a part of the device.

The presser foot device 10 comprises: a presser foot guide rod 13 which is fixed to a base frame 1 (see FIG. 4) through a support member 11; a cylinder member 15 which is slidably attached to the presser foot guide rod 13; a presser foot 19 which is supported by the cylinder member 15 and which is downward urged by a spring 17; a link mechanism 20 for vertically moving the cylinder member 15 along the guide rod 13; a height controlling mechanism 40 for changing the level of the presser foot 19 through the link mechanism 20; and a presser foot driving cam 52 which is fixed to a main shaft 50 through an attach member 51 (see FIG. 1) so as to operate the link mechanism 20 in accordance with the rotation of the main shaft 50.

The link mechanism 20 is configured by a first link 21, a second link 22, a third link 23, a fourth link 24, a fifth link 25, and a sixth link 26 which are arranged in this sequence starting from the above. One end 21*a* of the first link 21 is fixed to a rotation shaft 31. A cam follower 21*c* is attached to a shaft 21*d* of the other end (free end) 21*b*. The cam follower 21*c* is fitted into a cam groove 53 of the presser foot driving cam 52. An upper end 22*a* of the second link 22 is coupled to the free end 21*a* of the first link 21. A rear end 23*a* of the third link 23 is coupled to a shaft g2 of the lower end 22*b* of the second link 22. An upper end 24*a* of the fourth link 24 is coupled to a shaft g1 of the front end 23*b* of the third link 23. These couplings are performed in a rotatable manner. A cam follower 23*c* which is to be fitted into a guide cam 42 of the height controlling mechanism 40 that will be described later is disposed on the shaft g2 which is positioned at the joint of the rear end 23*a* of the third link 23. When the reciprocation direction is not restricted, the joint g2 can be operated in any direction and there may arise a case where a force is hardly transmitted.

By contrast, the lower end 24*b* of the fourth link 24, and a rear end 25*a* of the fifth link 25 are fixed through a rotation shaft 32 so as to form a predetermined angle. The rotation shaft 32 and the rotation shaft 31 which has been described above are supported by the base frame 1 so as to be rotatable at a predetermined position (see FIG. 2). An upper end 26*a* of the sixth link 26 is rotatably coupled to a shaft 25*c* of the front end 25*b* of the fifth link 25. The lower end 26*b* of the sixth link 26 is rotatably coupled to an upper end 15*a* of the cylinder member 15 through a shaft 26*c*.

According to this configuration, when the main shaft 50 is rotated, the arm-like links 21 to 26 which constitute the elements of the link mechanism 20 perform operations which are indicated by arrows shown in the vicinity of the links, respectively, so that presser foot 19 is vertically moved in a predetermined range.

Next, the height controlling means 40 which is an example of the joint movement direction controlling means will be described.

Figure 3:
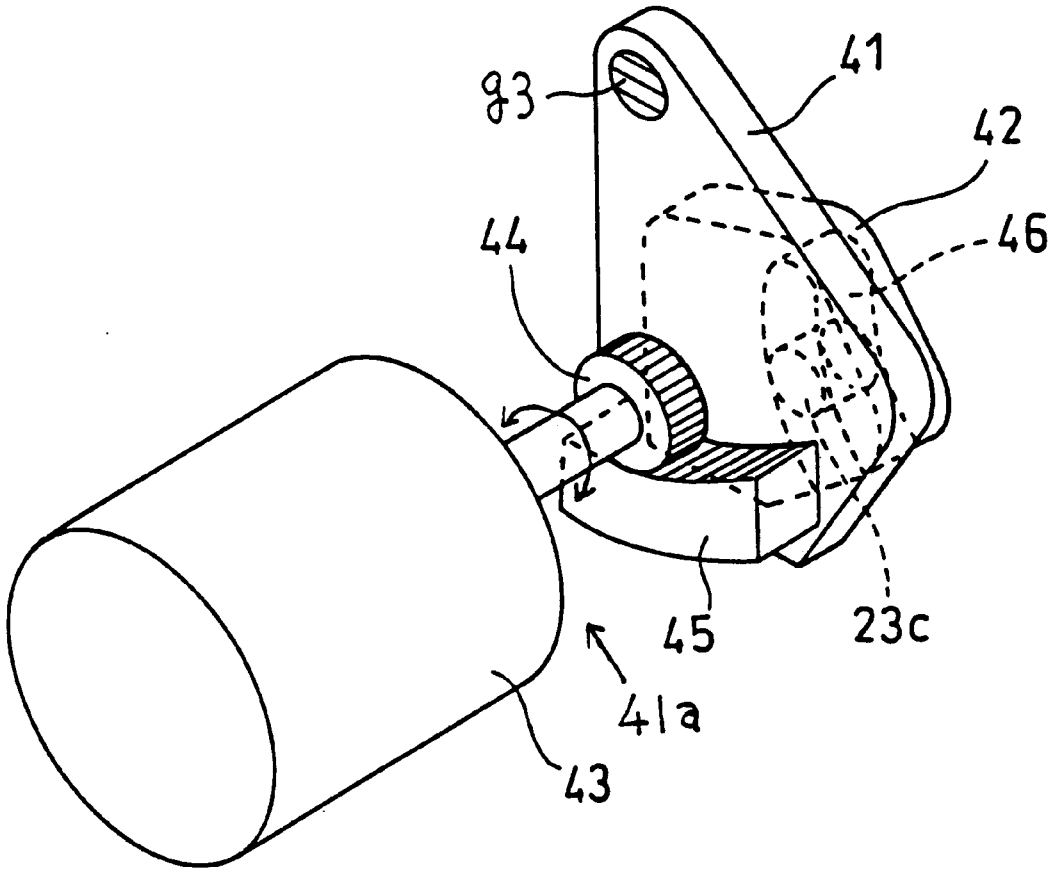
FIG. 3 is a perspective view showing the configuration of a height controlling mechanism of the embodiment.

The mechanism 40 serving as the height controlling means comprises: a control plate 41 which is rotatably supported at an upper end by a shaft g3 of the base frame 1; the guide cam 42 into which the cam follower 23*c* disposed on the shaft g2 is fitted; and guide cam moving means 41*a* for inclining the guide cam 42 fixed to the control plate 41 by controlling the inclination of the control plate 41. In the embodiment, a motor 43 having an electromagnetic brake which is operated under nonenergization state is used in the guide cam moving means 41*a*. The motor 43 is attached to a plate 43*a* continuous to the base frame 1. As shown in FIG. 3, the control plate 41 can be swung by the motor to a desired angle through a pinion gear 44 and an arcuate rack 45 and the inclined state can be held. In place of the motor 43, any other rotation driving device such as a rotary solenoid 4 3*b* shown in FIG. 13 may be used. An arcuate cam groove 46 is formed in the guide cam 42.

Figure 4:
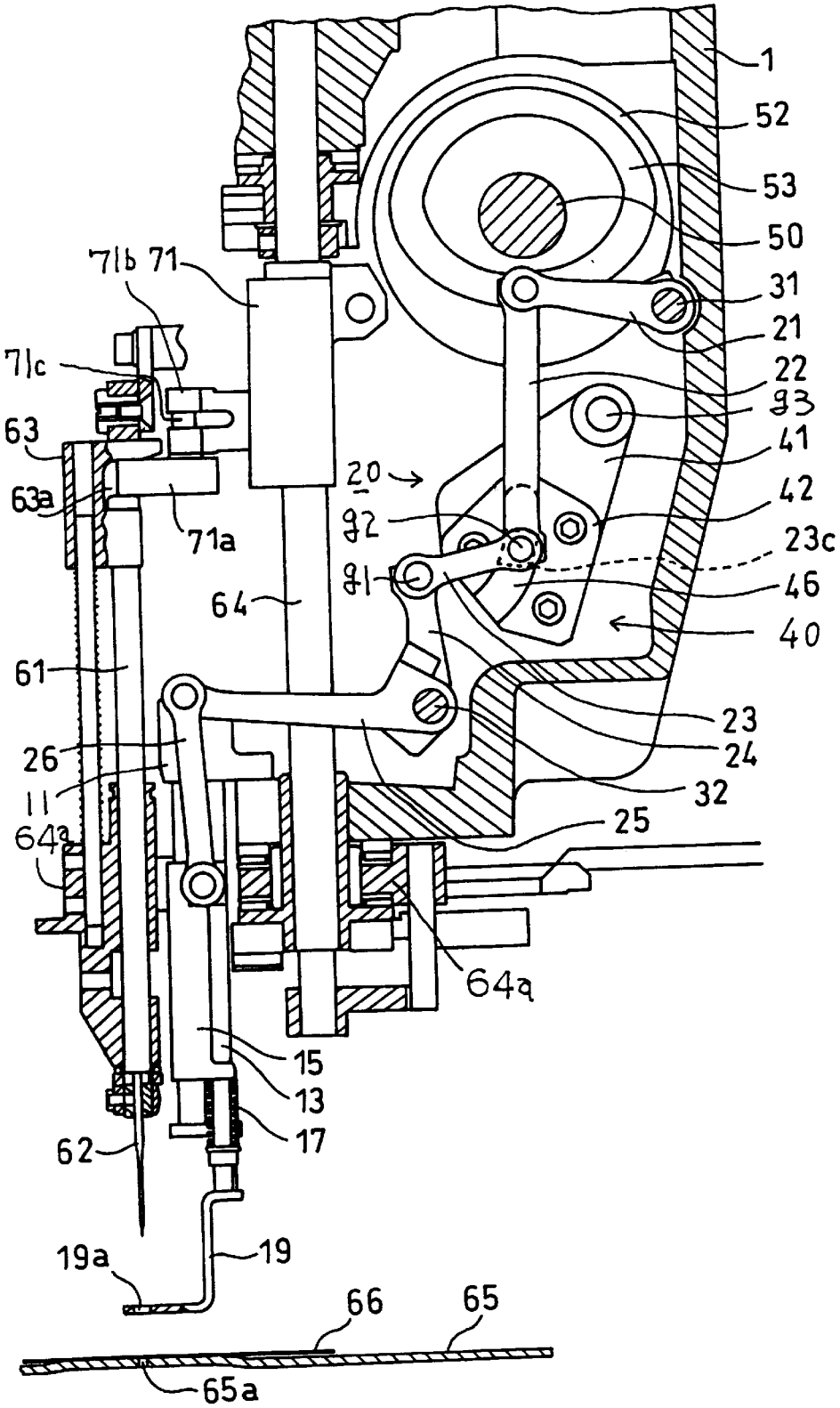
FIG. 4 is a section view showing the sewing operation of the embodiment.
Figure 5:
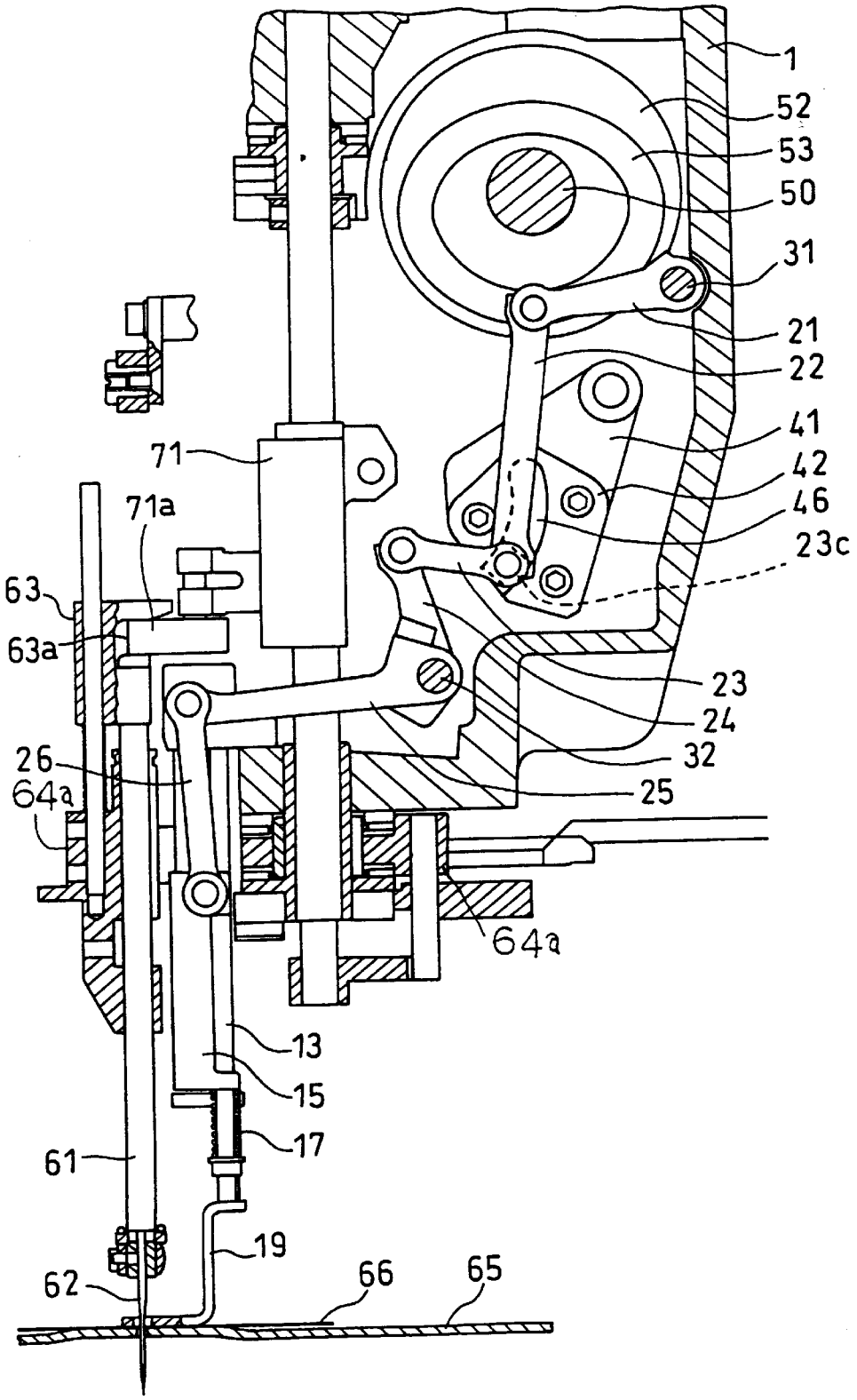
FIG. 5 is a section view showing a sewing operation of the embodiment.
Figure 6:
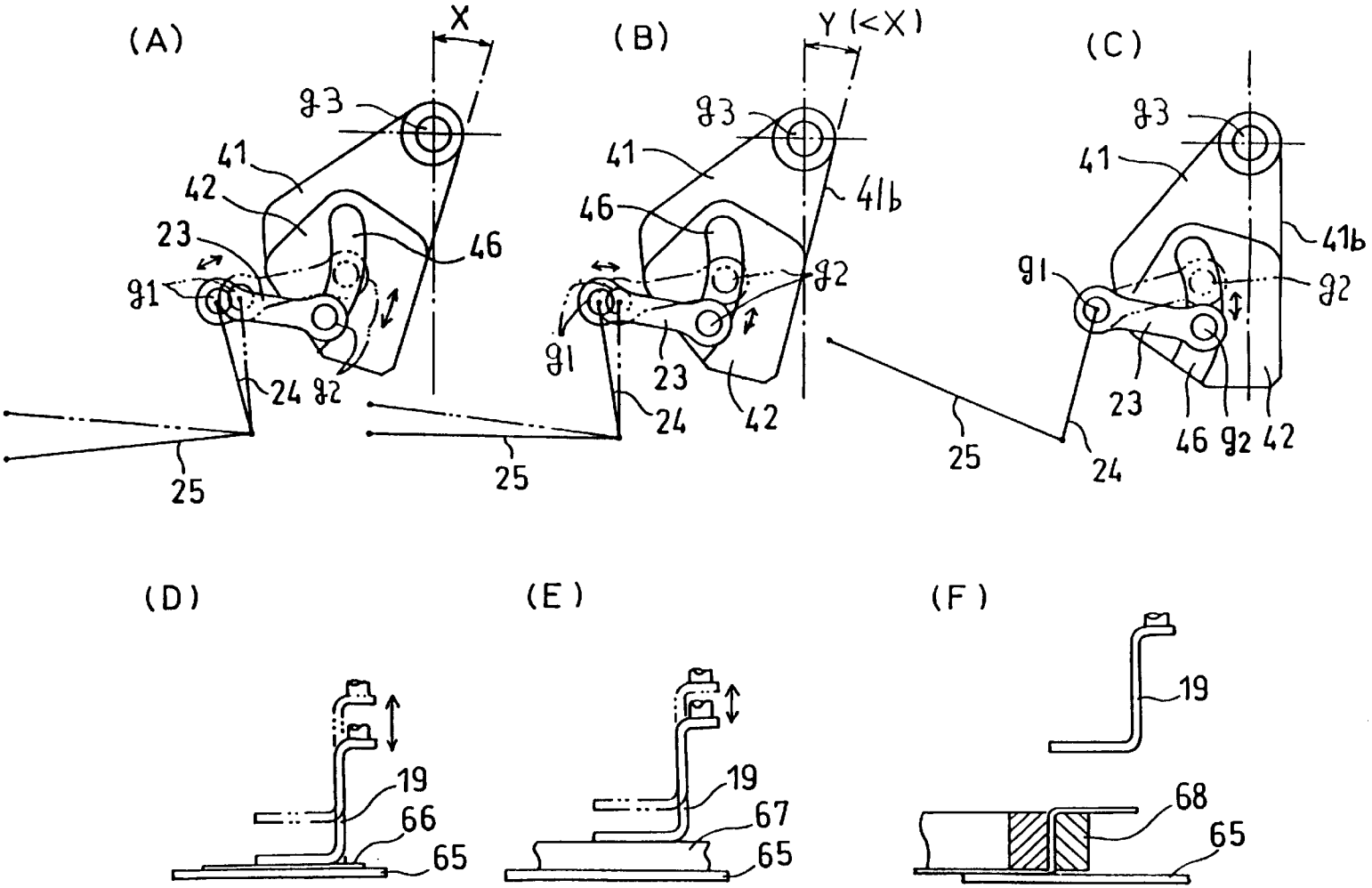
FIG. 6 is a diagram illustrating the manner of the operation of the height controlling mechanism in the sewing and retraction operations of the embodiment.

Next, the operation of the presser foot device 10 of the embodiment will be described. FIGS. 4 and 5 show the movements of the link mechanism 20 and the presser foot 19 during the sewing operation. In the figures, 61 designates a needle bar. The needle bar 61 is one of plural needle bars 61 which are aligned so as to be vertically movable with respect to a rotation plate 64*a* that is rotatable about a guide rod 64 as described also in Japanese patent publication (Kokai) No. 04292194 A and well known in the art. A sewing needle 62 is disposed at the lower end of each needle bar 61. A driven piece 63 which is engaged with a driving piece 71*a* of a needle bar driving elevation member 71 is attached to the upper end of the needle bar 61. Threads of different kinds are passed through the sewing needles 62 attached to the plural needle bars 61, respectively. In the sewing operation, the rotation plate 64*a* is rotated so that the selected needle bar 61 is located above a through hole 65*a* and at a position where the driving piece 71*a* is engaged with the corresponding driven piece 63, and one of the plural sewing needles 62 is then vertically driven so as to be used in the sewing operation.

As well known, the needle bar driving elevation member 71 is coupled through a lever crank mechanism (not shown)

to a crank rod 73 which is vertically moved by an eccentric ring 72 (both the elements are shown in FIG. 1) attached to the main shaft 50, and vertically moved in synchronization with the rotation of the main shaft 50. By contrast, the driving piece 71*a* is coupled to the elevation member 71 which is attached to the driving piece guide rod 64 so as to be vertically movable. The coupling is configured in the following manner. A rotation shaft 71*c* projecting from the driving piece 71*a* is rotatably disposed on an arm 71*b* projecting from the elevation member 71. A free end of the driving piece 71*a* is coupled to a fitting portion 6 3*a* of the driven piece 63 so that the fitting can be freely canceled in a lateral direction. As well known, the rotation of the driving piece 71*a* is controlled by a rotary solenoid which is not shown.

When the needle bar driving elevation member 71 is vertically moved in synchronization with the rotation of the main shaft 50, therefore, also the needle bar 61 is vertically moved and the sewing needle 62 is vertically moved between a position where the sewing needle passes through a throat plate 65 and another position where the needle escapes from the throat plate 65, thereby executing the sewing operation. At this time, also the presser foot driving cam 52 is rotated in accordance with the rotation of the main shaft 50, and the links 21 to 26 and the presser foot 19 are operated as indicated by the arrows in FIG. 1. FIG. 4 shows the state where the needle bar 61 and the presser foot 19 are raised to the highest level during the sewing operation, and FIG. 5 shows the state where they are conversely lowered to the lowest level.

In the figures, 66 designates cloth. As illustrated, the driving piece guide rod 64 and the presser foot guide rod 13 are attached in parallel with each other. An axis of the sewing needle 62, a center of a through hole 19*a* of the presser foot 19, and a center of the through hole (needle location) of the throat plate 65 coincide with each other. During the operation of the device, therefore, the vertical direction of the needle bar is coincident with the direction of the movement of the center of the through hole 19*a* of the presser foot 19, and hence the needle bar does not collide with the presser foot.

Next, the change of the level of the presser foot 19 which is a feature of the embodiment will be described with reference to FIGS. 6(A) to 6(F). FIGS. 6(A) and 6(D) correspond to the state illustrated in FIGS. 4 and 5 and show the inclined state of the control plate 41 in the case where embroidery is to be made on normal thin cloth 66. FIGS. 6(B) and 6(E) show the inclined state of the control plate 41 in the case where embroidery is to be made on thicker cloth 67 (for example, cloth which is covered with a urethane sheet). In these states, when the joint g2 is reciprocally moved in the direction of an arrow, the joint g1 is reciprocally laterally moved as shown in the figures (the joint is reciprocally moved between the positions which are indicated by the solid line and the two-dot chain line, respectively). FIGS. 6(C) and 6(F) show the state of the control plate in the case where the presser foot 19 escapes to a retraction position which is set at a high level. For example, this case occurs when the sewing machine is independently stopped, or when a taboret 68 is to be moved. The arcuate cam groove 46 is configured so that, under the state in which the presser foot 19 escapes to the retraction position, it stops at a position where a center of the cam groove coincides with an arcuate locus in which the radius is equal to the length between the joints g1 and g2 of the link and which is centered at the joint g1 that is on the left side in the figures. Even if the main shaft 50 is rotated under this state, therefore, the joint g2 performs only the reciprocal movement in the directions of the arrow between the positions respectively indicated by the solid line and the two-dot chain line, and the movement is not transmitted to the portions which are lower than the fourth link 24, with the result that the presser foot 19 is continued to be held at the retraction position. The inclination of the control plate 41 can be changed by driving the motor 43 in a predetermined direction by an amount which is electrically preset.

In the embodiment, when embroidery is to be made on the thicker cloth 67, the motor 43 is driven so that a rear edge 41*b* of the control plate 41 is continuously moved to a position where an angle Y (<X) which is smaller than that of the usual case is formed with respect to a vertical line as shown in FIG. 6(B), so as to be set at an arbitrary position. As a result, the position and angle of the cam groove 46 of the guide cam 42 are changed and the presser foot 19 is vertically moved at a level which is higher than that in the state of FIG. 6(A). When the taboret 68 is to be moved, the motor 43 is driven so as to set the rear edge 41*b* of the control plate 41 to be vertical as shown in FIG. 6C. As a result, the presser foot 19 is raised to the retraction position.

After the presser foot 19 is retracted in this way, the taboret 68 is moved below the presser foot. Thereafter, the motor 43 is driven by a predetermined amount in the direction opposite to that in the above-mentioned case, so that the inclination state of the control plate 41 is returned from the state of FIG. 6(C) to that of FIG. 6(A) or 6(B). As a result, a state in which embroidery can be restarted is attained.

In the embodiment, also at the retraction position, the cam follower 23*c* disposed at the rear end 23*a* of the third link 23 remains to be engaged with the cam groove 46 of the guide cam 42. The presser foot 19 performs only the movement in the vertical direction between the sewing position and the retraction position. Also at the retraction position and in the course of returning from the retraction position to the sewing position, therefore, the center of the through hole 19*a* of the presser foot 19 coincides with an axis of the sewing needle 62. As a result, in the embodiment, the rotation of the main shaft 50 can be restarted before the presser foot 19 is completely returned from the retraction position to the sewing execution position, and hence the waiting time period from the retraction state to the restart of embroidery can be shortened. With respect to one retraction operation, the degree of the above-mentioned shortening may be very small. In an embroidery factory, the retraction operation is conducted at a very huge number of times during one day. When the shortened time periods for the retraction operations are accumulated, therefore, the resulting accumulated shortened time period has a large value, with the result the operation rate of the sewing machine can be greatly improved. As described above, during the retraction operation, the rotary movement of the main shaft 50 is not transmitted to the portions which are lower than the fourth link 24. As far as the needle bar 61 is set to be in a jump state, therefore, there arises no problem even when the rotation of the main shaft 50 is continued.

The embodiment is configured so that the cam follower 23*c* is always engaged with the arcuate cam groove 46 of the guide cam 42. Unlike a configuration in which a strong urging force is applied to a cam in order to maintain an engagement state as proposed in, for example, Japanese patent publications (Kokai) Nos. HEI7-231991 and HEI6-238078, and particularly that in which a high speed operation is attained and a strong urging force is applied in order to strongly maintain the engagement state with the cam, therefore, it is not required for the configuration of the embodiment to apply a strong urging force to the cam in order to maintain the engagement state with the cam. Consequently, the load exerted in the case where the presser foot 19 is retracted is restricted only to the load for moving the link mechanism 20. As a result, it is possible to reduce not only the load of the main shaft under the retraction state, but also the load exerted on the main shaft during a high-speed operation. With respect to a one-head sewing machine, the elimination of the load due to the urging force of a spring does not result in a large reduction of a load. In a multi-head sewing machine which is mainly used in an embroidery factory, such small loads are accumulated on the main shaft, and hence the load is greatly reduced as a result of accumulation of the load reductions of the respective heads.

In the embodiment, the first link 21 which can be rotated by the rotation shaft 31 serves as a first swing member, and the fourth and fifth links 24 and 25 which can be rotated by the rotation shaft 32 serve as a second swing member. In the embodiment, the fourth link 24 corresponds to a first arm, and the fifth link 25 to a second arm.

Another example shown in FIGS. 7 to 11 of the controlling means having the same function as the joint movement direction controlling means 40 in the presser foot device for a sewing machine shown in FIGS. 1 to 6 will be described. In the following description, regarding FIGS. 7 to 13, the portions which are seemed to have the same or equivalent configuration are designated by the same reference numerals as those in the preceding figures and their duplicated description is omitted.

Figure 11:
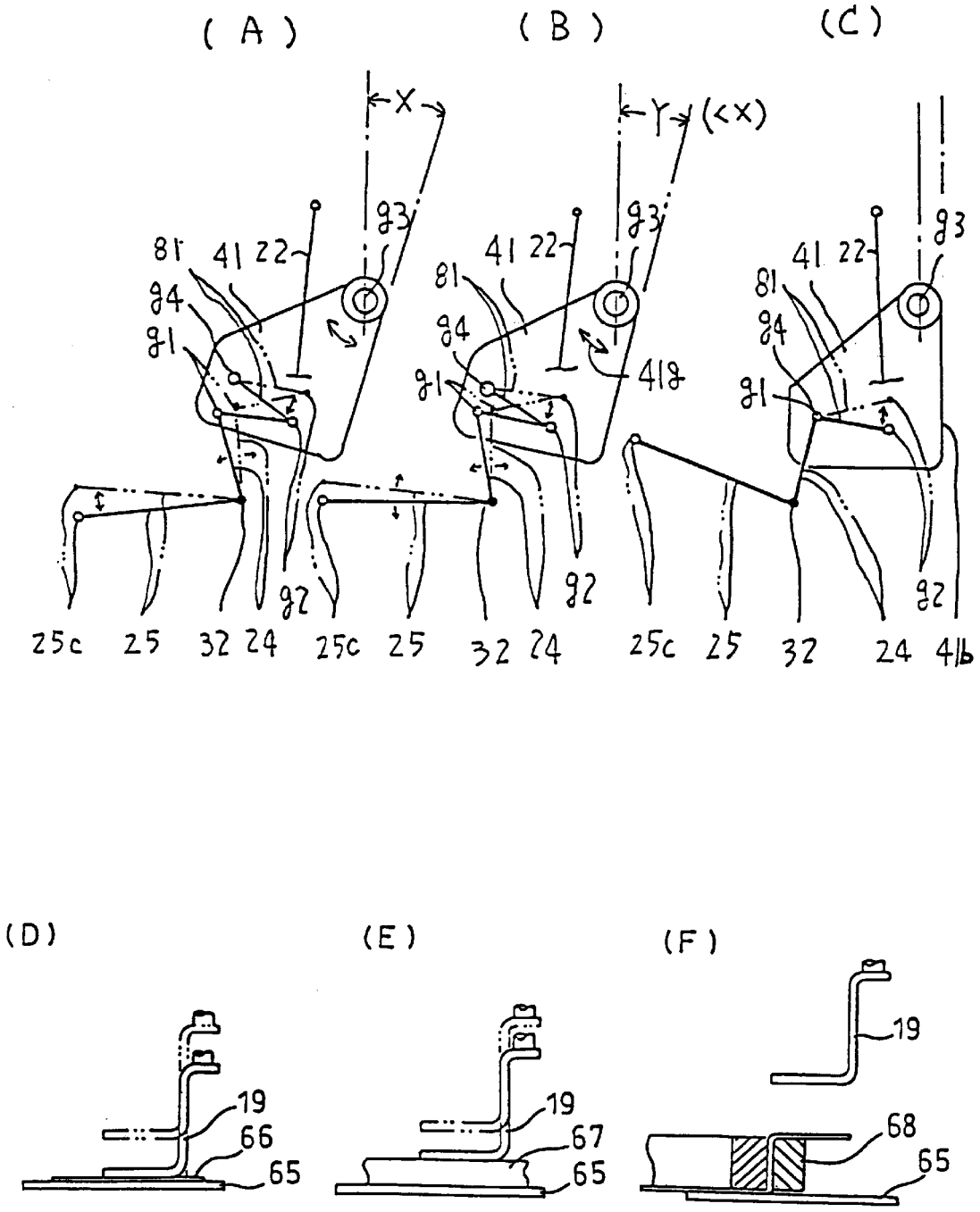
FIG. 11 is a diagram illustrating the manner of the operation of a height controlling mechanism in the sewing and retraction operations of the other embodiment.

In a guide arm 81 of the joint movement direction controlling means 80, a basal portion 81*a* is rotatably attached to a shaft g4 disposed on the control plate 41 of guide arm moving means 80*a*, a tip end portion 81*b* is rotatably coupled to the shaft g2, and the reciprocal movement of the shaft g2 is guided at a radius using the shaft g4 of the basal portion 81*a* of the guide arm 81 as a fulcrum (see also FIG. 11). The relative positional relationship between the opposing shafts g4 and g2 can be swingingly changed in the direction of arrows shown in FIG. 11 by rotating the motor 43 so as to rotate the control plate 41 of the guide arm moving means 80*a* about the shaft g3.

According to this configuration, as compared with the configuration of the cam type shown in FIG. 1, an action corresponding to rattling between the cam follower 23*c* and the cam groove 46 can be eliminated, thereby producing an effect that the accuracy is improved. As compared with the configuration of the cam type in which the guide cam 42 having the groove 46 and the cam follower 23*c* are formed, the system having the guide arm 81 can be configured only by the shaft g4 and the guide arm 81 and therefore has features that the cost of parts is low and that the working cost is reduced.

Figure 7:
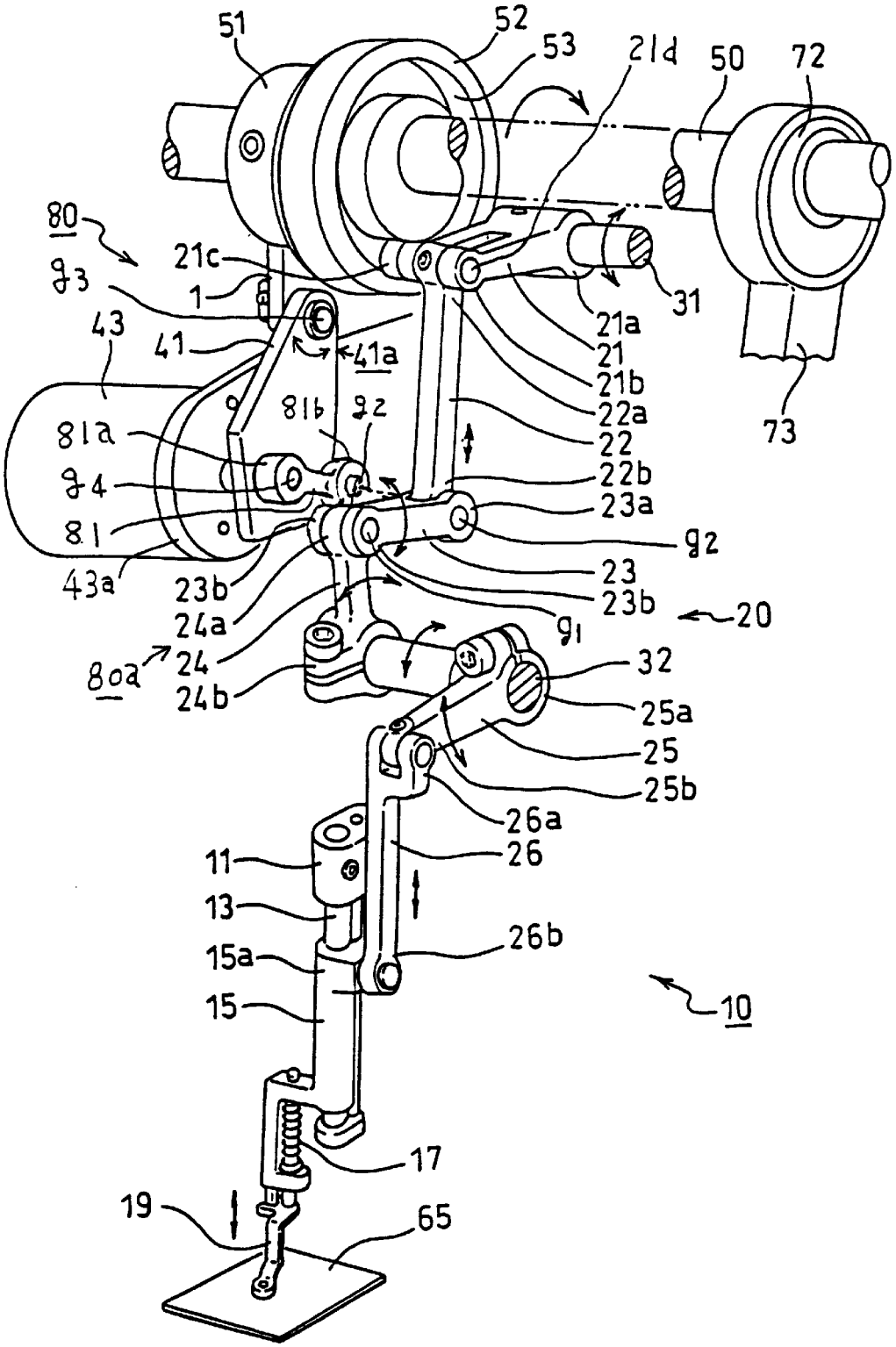
FIG. 7 is a perspective -view showing main portions of a presser foot device for a sewing machine of another embodiment.

The operation of the joint movement direction controlling means 80 shown in FIG. 7 and configured by the guide arm moving means 80*a* and the guide arm 81 is shown in FIG. 11. The operation shown in FIG. 11 is substantially identical with that shown in FIG. 6. In order to make sure, however, the operation will be described. FIGS. 11(A) and 11(D) correspond to the state illustrated in FIGS. 9 and 10 and show the inclined state of the control plate 41 in the case where embroidery is to be made on normal thin cloth 66. FIGS. 11(B) and 11(E) show the inclined state of the control plate 41 in the case where embroidery is to be made on thicker cloth 67 (for example, cloth which is covered with a urethane sheet). In these states, when the joint g2 is reciprocally moved in the direction of the arrow, the joint g1 is reciprocally laterally moved as shown in the figures (the joint is reciprocally moved between the positions which are indicated by solid line and two-dot chain line, respectively). FIGS. 11(C) and 11(F) show the state of the control plate 41 in the case where the presser foot 19 escapes to a retraction position which is set at a high level. For example, this case occurs when the taboret 68 is to be moved. Under the state in which the presser foot 19 escapes to the retraction position, the shaft g4 is aligned with the shaft g1. The shaft g2 is configured so as to be vertically moved in an arcuate locus in which the radius is equal to the length between the joints g1 and g2 of the link and which is centered at the joint g1 that is on the left side in the figures. Even if the main shaft 50 is rotated under this state, therefore, the joint g2 performs only the reciprocal movement in the directions of the arrow between the positions respectively indicated by the solid line and the two-dot chain line, and the joint g1 is not moved. Consequently, the movement is not transmitted to the portions which are lower than the fourth link 24, with the result that the presser foot 19 is continued to be held at the retraction position. The inclination of the control plate 41 can be changed by driving the motor 43 in a predetermined direction by a preset amount.

Figure 9:
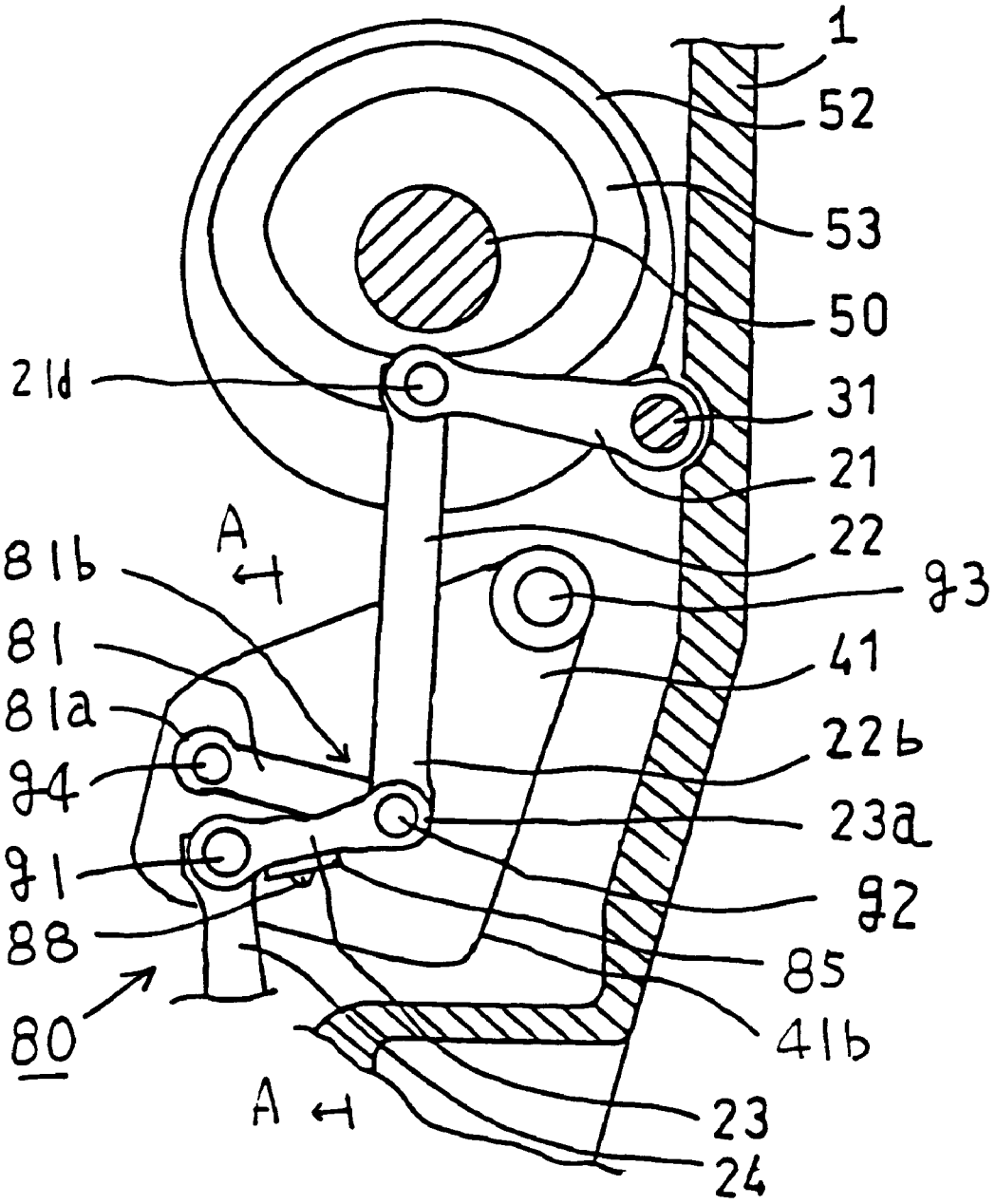
FIG. 9 is a section view showing a sewing operation of joint movement direction controlling means in the other embodiment.
Figure 10:
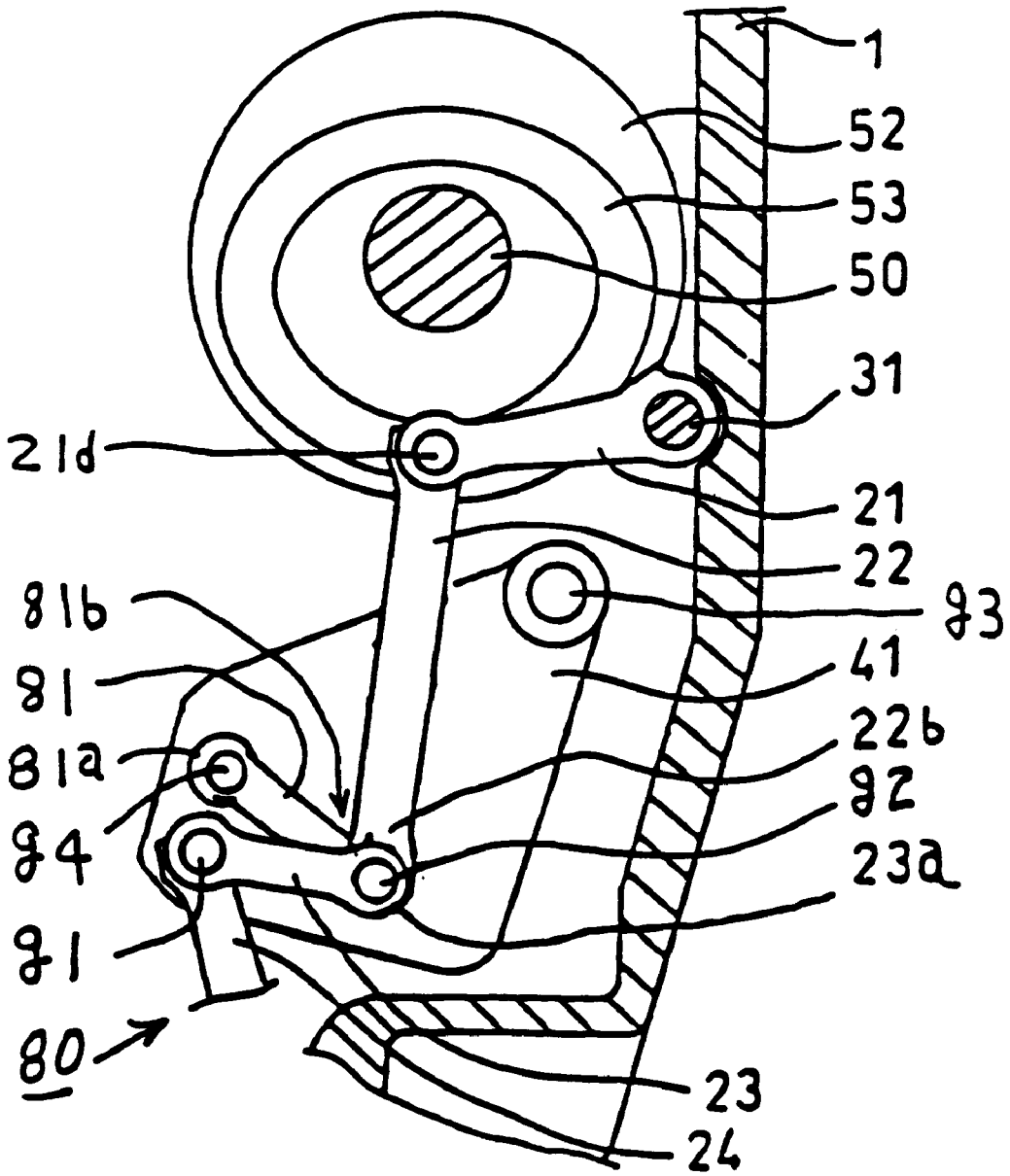
FIG. 10 is a section view showing a sewing operation of the joint movement direction controlling means in the other embodiment.
Figure 12:
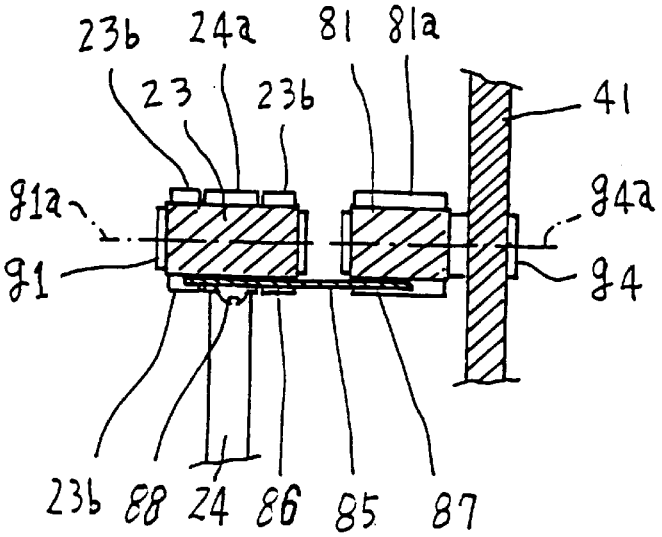
FIG. 12 is a section view taken along the line A—A in FIG. 9 and showing the disposition of a positioning piece.

A positioning piece 85 shown in FIGS. 9 and 12 is detachably fixed at a basal portion 86 to the third link 23 by a screw 88, and separably abuts at a free end 87 against the guide arm 81 (or the control plate 41 which supports the basal portion of the arm). With respect to the timing of the abutment, under the states of FIGS. 11(A) and 11(B), the axes of the shafts g1 and g4 are separated from each other, and hence the shafts are not contacted with each other even when the shaft g2 is vertically moved. By contrast, when the rotation is performed so as to attain the state of FIG. 11(C), a shaft axis g1*a* coincides with a shaft axis g4*a* as shown in FIG. 12, and hence the free end 87 abuts against the lower face of the guide arm 81.

When, in the controlling means for the motor 43, the stop position of the control plate 41 is to be set at the position of FIG. 11(C) at the shipment from the factory or after an overhaul, the control plate 41 is rotated from the position of FIG. 11(B) so as to be oriented in a direction of FIG. 11(C). As a result, the free end 87 abuts against the guide arm 81 and the movement of the control plate 41 is stopped. In other words, the stop position is the position to be obtained where the shaft axis g1 a coincides with the shaft axis g4*a*.

Figure 8:
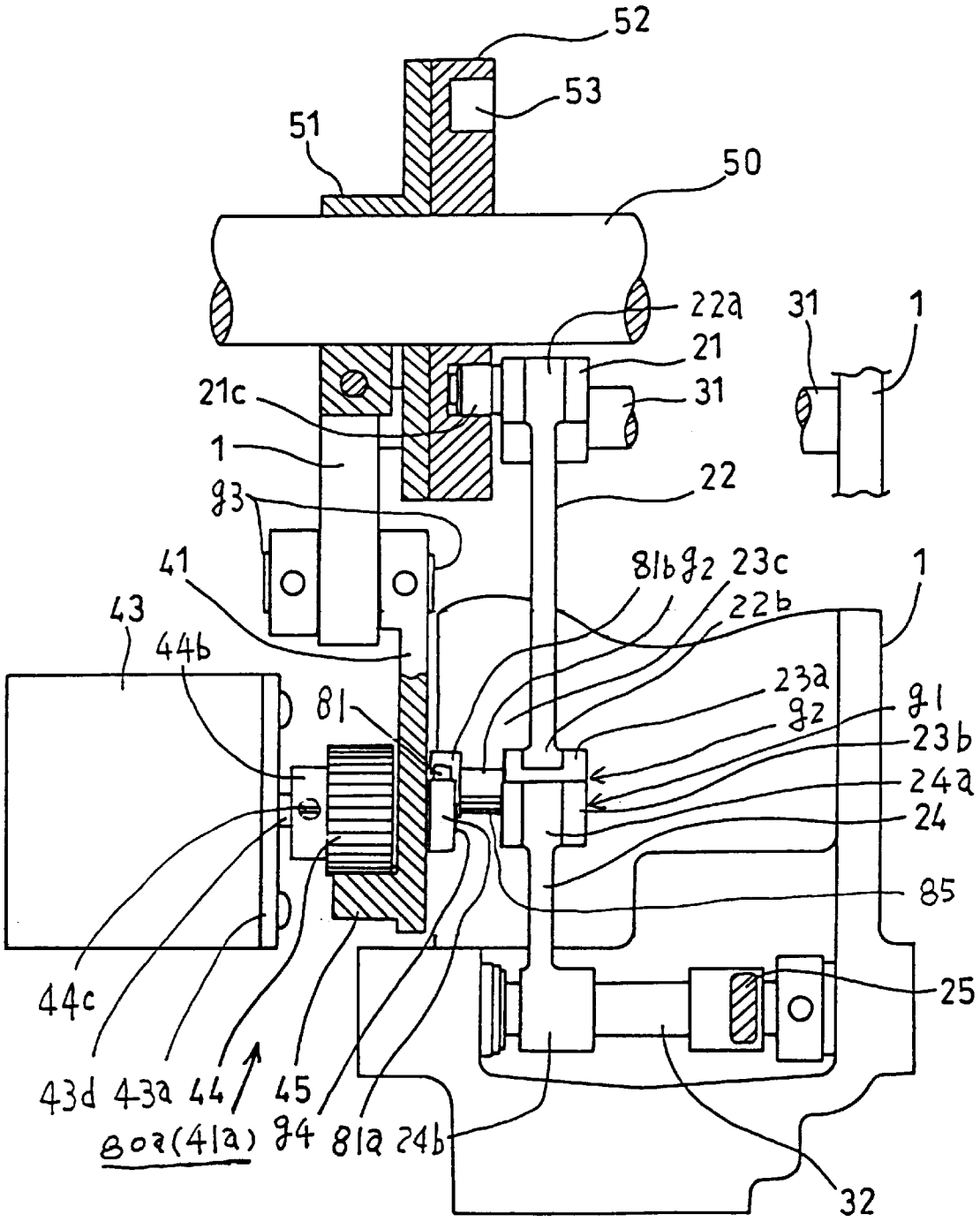
FIG. 8 is an enlarged section view of a part of the presser foot device for a sewing machine of the other embodiment.

An adjusting ring 44*b* fixed to the pinion gear 44 of FIG. 8 is configured so that the rotation angle with respect to the motor shaft 43*d* can be reset by loosening a fixing screw 44*c*. After the fixing screw 44*c* is loosened, the control plate 41 can be conveniently manually set to the position of FIG. 11(C).

In the embodiment, when embroidery is to be made on the thicker cloth 67, the motor 43 is driven so that the rear edge 41*b* of the control plate 41 is continuously moved to a position where an angle Y (<X) which is smaller than that of the usual case is formed with respect to a vertical line, so as to be set at an arbitrary position. As a result, the position of the shaft g4 of the guide arm 81 is changed, the movement direction of the joint g2 is changed, and the presser foot 19 is vertically moved at a level which is higher than that in the state of FIG. 11(A). When the taboret 68 is to be moved, the motor 43 is driven so as to set the rear edge 41*b* of the control plate 41 to be vertical. As a result, the presser foot 19 is raised to the retraction position as shown in FIG. 11(F).

After the presser foot 19 is retracted in this way, the taboret 68 is moved below the presser foot. Thereafter, the motor 43 is driven by a predetermined amount in the direction opposite to that in the above-mentioned case, so that the inclination state of the control plate 41 is returned from the state of FIG. 11(C) to that of FIG. 11(A) or 11(B). As a result, the movement direction of the joint g2 is changed to restrict the reciprocation locus, and a state in which embroidery can be restarted is attained.

The embodiment described above is an example of the execution of the invention. The invention may be executed in various manners. For example, the motor 43 may be replaced with a motor other than that having an electromagnetic brake which is operated under nonenergization state, as far as the motor is configured so that, even when the motor is stopped, the motor shaft can not be rotated.

Figure 13:
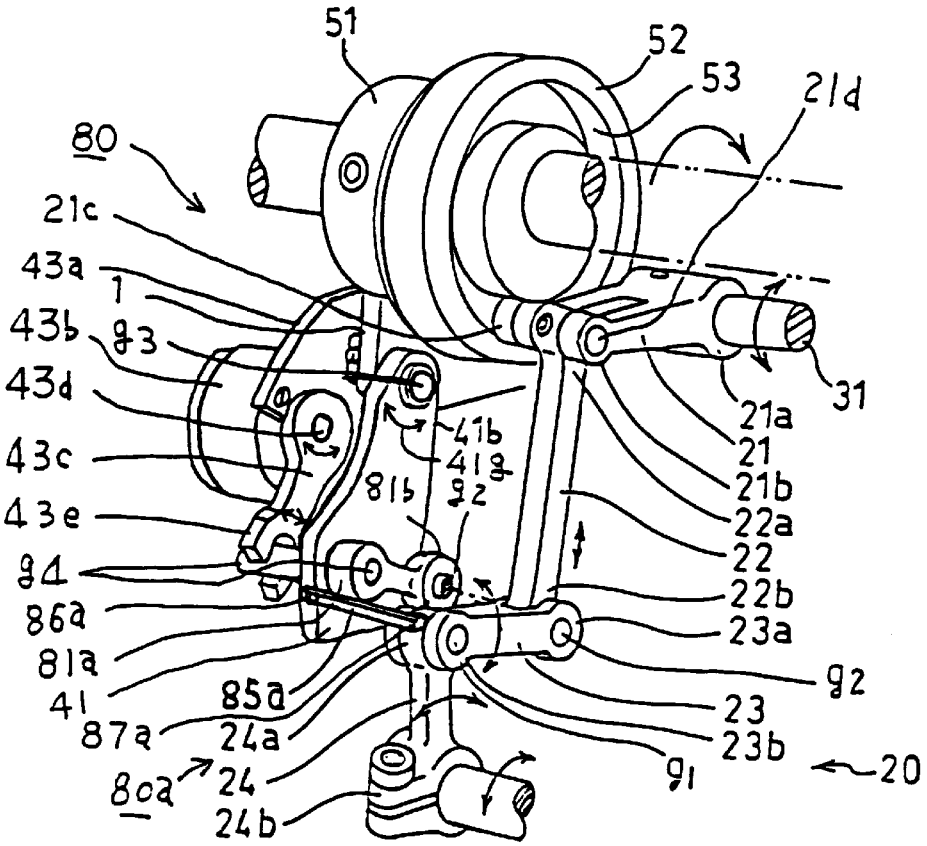
FIG. 13 is a perspective view showing another example of guide arm moving means.

FIG. 13 shows an example in which a well-known solenoid motor is used in place of the motor 43. The solenoid motor 43*b* is attached to a fixing plate 43*a*. An arm 43*c* is fitted to a rotation shaft 43*d* of the motor. A U-shaped linkage piece 43*e* at the free end of the arm 43*c* is engaged with an extension portion of the shaft g4 so that the rotation of the linkage piece 43*e* in the direction of an arrow causes the control plate 41 to be reciprocally swung in the direction of an arrow 41*g* in the range of FIGS. 11(A) to 11(C).

A positioning piece 85*a* of FIG. 13 is attached to a position which is different from that shown in FIG. 12. A basal portion 86*a* is fixed to a part of the control plate 41, and, when the shafts g4 and g1 become concentric with each other, a free end 87*a* abuts against an upper position 24*a* of the fourth link 24. The timing of the abutment is set in the same manner as that of the free end 87 of the positioning piece 85 of FIG. 12. The use and function of the positioning piece 85*a* are identical with those of the positioning piece 85.

Conventionally, the work of obtaining the position where the axes g1*a* and g4*a* coincide with each other at the shipment from the factory or after an overhaul is conducted on the instinct of the worker. The provision of the positioning piece 85 or 85*a* enables the work to be conducted depending on the positioning piece 85 or 85*a*. As a result, the adjusting work of obtaining the coincident point shown in FIG. 11(C) can be conducted rapidly and correctly. Usually, complex mechanisms are placed around the control plate 41. Since the above-mentioned work is conducted in a space surrounded these mechanisms, it is very difficult to manually conduct the work. The provision of the positioning piece 85 is useful for solving the problem and attains the above-mentioned effects.

What is claimed is:

1. A presser foot device for a sewing machine in which a presser foot is vertically moved toward a needle location in a predetermined range in accordance with a movement of a needle bar, and said presser foot is retracted as required to a position which is higher in level than the vertical movement range, said device comprising:

a cam for driving said presser foot, said cam being fixed to a main shaft; and a link mechanism having: a first swing member which is swung in a predetermined range by said cam; and a second swing member which is coupled to said first swing member through a link, which is coupled to said presser foot through a link, and which is swung in response to the swinging movement of said swing member, thereby vertically moving said presser foot, said device further comprising:

a guide cam having an arcuate cam groove into which a cam follower disposed on one joint of said link mechanism is fitted to move in a predetermined direction said joint in reciprocation locus; and guide cam moving means for changing a position of said guide cam to change the movement direction of said joint, thereby causing said second swing member to operate so as to vertically move said presser foot in a predetermined range, and said presser foot to be set in a raised state in which said presser foot is raised to a retraction position.

2. A presser foot device for a sewing machine according to claim 1, wherein said second swing member comprises a first arm which elongates toward said first swing member, and a second arm which elongates toward said presser foot, two or more links are disposed between said first arm and said first swing member, said cam follower which is engaged with said arcuate cam groove is disposed on a joint of said link coupled to said first arm, said joint being on a side opposite to said first arm, and said guide cam moving means is configured so that, when the position of said guide cam is changed so as to set said second swing member to be in the raised state, said arcuate cam groove coincides with an arcuate locus which is centered at a joint on a side of a free end of said first arm.

3. A presser foot device for a sewing machine in which a presser foot is vertically moved in a predetermined range in accordance with a movement of a needle bar, and said presser foot is retracted as required to a position which is higher in level than the vertical movement range, said device comprising:

a presser foot driving cam which is fixed to a main shaft;

a first swing member which is swingably supported by a base frame, and in which a free end portion is engaged with a cam groove of said presser foot driving cam through a first cam follower;

a second swing member which is disposed between said first swing member and said presser foot, which is swingably supported by said base frame, and which comprises a first arm which elongates toward said first swing member, and a second arm which elongates toward said presser foot;

at least two swing member links which are disposed so as to couple said first arm of said second swing member with said first swing member;

a second cam follower which is disposed on a joint of a link on a side opposite to said first arm, said link being one of said at least two swing member links, said one swing member link being coupled to said first arm;

a guide cam having an arcuate cam groove with which said second cam follower is engaged, said guide cam being swingably attached to said base frame;

guide cam swinging means for swinging said guide cam with respect to said base frame to change a position of said arcuate cam groove; and a presser foot coupling link which couples said second arm of said second swing member with said presser foot, said guide cam swinging means being configured so that, when the position of said guide cam is swung so as to set said second swing member to be in the raised state in which said presser foot is raised to a retraction position, said arcuate cam groove coincides with an arcuate locus which is centered at a joint on a side of the free end of said first arm.

4. A presser foot device for a sewing machine in which a presser foot is vertically moved toward a needle location in a predetermined range in accordance with a movement of a needle bar, and said presser foot is retracted as required to a position which is higher in level than the vertical movement range, said device comprising:

a cam for driving said presser foot, said cam being fixed to a main shaft;

a link mechanism having a first swing member which is swung in a predetermined range by said cam and a second swing member which is coupled to said first swing member through a link, which is coupled to said presser foot through a link, and which is swung in response to the swing movement of said swing member, thereby vertically moving said presser foot; and joint movement direction controlling means for changing a swing direction and a swing position of one joint in said link between said first swing member and said second swing member, said joint movement direction controlling means, in an operation state where said presser foot is vertically moved in a lower level, maintaining said one joint to a position where said one joint receives the swinging movement of said first swing member and swings in a direction along which a joint of said second swing member is largely swung, in a case where said presser foot is to be raised while gradually reducing an amplitude of said presser foot, slightly moving said one joint and maintaining said one joint to the position, and in a case where said presser foot is to be raised toward a retraction position, allowing said one joint to be freely moved to a position where said one joint is swung about said joint of said second swing member.

5. A presser foot device for a sewing machine in which a presser foot is vertically moved toward a needle location in a predetermined range in accordance with a movement of a needle bar, and said presser foot is retracted as required to a position which is higher in level than the vertical movement range, said device comprising:

a cam for driving said presser foot, said cam being fixed to a main shaft; and a link mechanism having a first swing member which is swung in a predetermined range by said cam, and a second swing member which is coupled to said first swing member through a link, which is coupled to said presser foot through a link, and which is swung in response to the swinging movement of said first swing member, thereby vertically moving said presser foot, said device further comprising:

guide arm moving means for changing a swing direction and a swing position of one joint in said link between said first swing member and said second swing member, said guide arm moving means comprising a guide arm and a control plate, said guide arm being coupled at a tip end portion to a shaft of said one joint in said link mechanism, and pivotally attached at a basal portion to a shaft of said control plate so as to enable said shaft of said one joint to move in a predetermined direction and in a predetermined reciprocation locus, said control plate, in an operation state where said presser foot is vertically moved in a lower level, setting a central axis of said basal portion of said guide arm to a position where the central axis is largely separated from the central axis of a joint of said second swing member and the swinging movement of said one joint is transmitted to said joint of said second swing member, in a case where said presser foot is to be raised while gradually reducing an amplitude of said presser foot, making the axis of said basal portion of said guide arm closer to an axis of said joint of said second swing member, and in a case where said presser foot is to be raised toward a retraction position, making the axis of said basal portion of said guide arm closer to a position where the axis of said basal portion overlaps with the axis of said joint of said second swing member.

* * * * *